US005645304A

United States Patent [19]

Richardson et al.

[11] Patent Number: 5,645,304

[45] Date of Patent: Jul. 8, 1997

[54] MOUNTING BRACKET FOR PRONG-TYPE LATCH

[76] Inventors: Laura Richardson; Ira L. Richardson, both of 2140 S. Walnut, Springfield, Ill. 62704

[21] Appl. No.: 610,052

[22] Filed: Feb. 29, 1996

[51] Int. Cl.[6] ..... E05C 19/00

[52] U.S. Cl. ..... 292/1; 292/19; 292/DIG. 38

[58] Field of Search ..... 292/1, 19, 76, 292/87, 81, DIG. 38, DIG. 65

[56] References Cited

U.S. PATENT DOCUMENTS

| | | | |
|---|---|---|---|
| 3,397,001 | 8/1968 | Friedman | 292/87 |
| 4,139,249 | 2/1979 | Hillman | 312/333 |
| 4,378,948 | 4/1983 | Chrones | 292/19 |
| 4,632,438 | 12/1986 | McKinney | 292/87 |
| 4,714,284 | 12/1987 | Varlet | 292/91 |
| 5,445,451 | 8/1995 | Harmony | 312/333 |

*Primary Examiner*—Rodney M. Lindsey
*Assistant Examiner*—Monica E. Millner
*Attorney, Agent, or Firm*—Joseph W. Holloway

[57] ABSTRACT

A bracket for a readily detachable prong receives and retains the prong in both its operative (upright) and inoperative (inverted) positions. The bracket may also provide an internal chamber or sheath for storing a detached prong.

7 Claims, 1 Drawing Sheet

MOUNTING BRACKET FOR PRONG-TYPE LATCH

This invention pertains generally to latches which limit opening of swinging cabinet doors and sliding drawers thereby denying access to potentially dangerous items and materials commonly stored about households. Several latches of this specific type are commercially available and are widely used where curious toddlers are present. U.S. Pat. No. 3,397,001 issued to Friedman discloses a typical child protective latch intended for this purpose which displays these general structural and operational characteristics:

An elongated flexible prong having its proximate end secured to an upright doer or drawer closure extends generally horizontally from such closure toward the interior of a cabinet or similar enclosed space.

Upon movement of such door or drawer toward its closed position, a hook-like projection extending upwardly from the distal end of the prong overrides a downwardly depending stop member attached to or formed by the cabinet framework. Thereafter, opening movement of the closure is limited by interferring abuttment of the prong hook against the stop member.

Such purposely limited opening movement is usually just enough to permit digital access to the prong whereby the prong may be depressed to disengage the hook from the stop member thereby allowing complete opening of the door or drawer.

These basic features are embodied in each of the defensive latches described in U.S. Pat. No. 4,378,948 issued to Chrones, U. S. Pat. No. 4,632,438 issued to McKinney, U.S. Pat. No. 4,714,284 issued to Varlet; and, U.S. Pat. No. 5,445,451 issued to Harmony.

Commonly, the flexible prong element of these latches has at its proximate end an integrally molded base or flange which provides means for attachment of the prong to a vertical door or drawer front. Typical of such integrally molded prong bases are those disclosed in the cited U.S. Patents to Friedman and Chrones. Friedman shows that his prong has a flanged base which is apertured and secured to a drawer front by plural screws. Chrones also relies on threaded fasteners for attaching the molded, generally rectangular base of his prong to an upright drawer closure.

A longstanding problem associated with defensive latches incorporating screw-attached prongs is the lack of a means for rendering such latches inoperable without troublsome dismanteling of either the prong or a coacting stop member, or both, from the cabinet door, drawer or framework, as the case may be. The provision of a means whereby a latch of the type under consideration may be quickly and simply disabled would be especially appreciated by relatives or caregivers of a child who is present in the household only occasionally. Without a simple disabling means, adults must either periodically remove and reinstall latches which guard selected doors and drawers about a household or expend the extra effort and. endure the aggravation involved in operating these latches even though children are no longer present.

Detachment of a screw-anchored prong base requires the use of some sort of tool and such detachment is often accompanied by the loss or misplacement of the screws and the detached latch components. Repetitious insertion and removal of screws with respect to a nonmetallic closure will eventually degrade the fastening ability of the screws' threads to such an extent that latch components become so loose that the latch altogether fails to perform its defensive function. In such an event, the latch components and attaching screws must be laboriously relocated, reattached and readjusted to render the latch operational once again. Should a child be brought into a household wherein protective closure latches are in a degraded or dismantled condition, failure to reactivate promptly all such latches could expose the child to harm. Missing latch parts, screw fasteners or lack of a suitable tool for reattaching the prongs of all door and drawer safety latches throughout the house would, in each such case, prolong the risk of harm to the child.

McKinney recognizes the need for a child protective latch having special provision for an inoperable position. He suggests that a flanged base formed at the proximate end of a prong be removably attached to a closure by a single screw which penetrates a slot opening through the base. After loosening this screw, the entire prong may be rotated about the longitudinal axis of the screw to shift the prong hook angularly out of latching alignment with an abutting portion of a cabinet. However, two of the above identified problems remain unsolved by McKinney's rotatable prong, namely: the need for some sort of tool for releasing and retightening the base holding screw with respect to the closure remains, and the degradation of the holding ability of the attachment screw after repeated loosening and tightening of the same is not obviated.

The child protective latches disclosed in the Varlet and Harmony patents do not employ latch prongs having screw-mounted bases. Instead, Varlet and Harmony utilize discrete prong mounting brackets which, after being appropriately fixed to a door or drawer closure, accept and releasably capture orthogonal bases formed integrally at the proximate ends of their respective prongs. The brackets according to Varlet and Harmony have recessed surface means which coact with detenting projections carried by their prong bases to maintain the bases and prongs in assembled relation. Both the Varlet and Harmony patents show that their detented prongs can be completely disassembled from associated mounting brackets, but only by means of a bladed tool, such as a screwdriver.

Somewhat similar to the Varlet and Harmony latches is the construction disclosed in the Hillman patent wherein a rigid prong has a flanged proximate end slidably received in a complementary track formed on a discrete mounting bracket. The rigid prong of Hillman is spring biased upwardly and digitally depressible to release the latch for full opening of a closure member. While Hillman fails to suggest that his prong could be detached for disabling his latch, detachment for this purpose appears possible.

While each of the cited patents to Varlet, Harmony and Hillman show discrete brackets from which the proximate ends of their prong could be selectively detached thereby rendering their respective latches inoperative, none suggests means for positioning and retaining a detached prong in association with a guarded closure so that it will not be misplaced or lost. This significant shortcoming is shared with Friedman-type screw mounted prongs.

In order to obviate the shortcomings of those prior art latches just discussed, child protective latch having means for rendering the same inoperative should display the following structural and operational features:

The prong element of the latch should be capable of simple detachment and rapid reattachment with respect to the movable closure member by means of a simple mounting bracket which is discrete from the prong itself.

Attachment and detachment of the prong from the bracket should be possible without using a tool.

The mounting bracket should provide means for storing a detached prong with the bracket in readiness for immediate reattachment of the prong to the bracket to restore the latch to its operative condition.

SUMMARY OF THE INVENTION

The principal object of this invention is the provision of a prong-type security latch which overcomes the disadvantages and shortcomings associated with available devices of this kind. A related general object is the provision of a latch of this type which embodies structure productive of each of those desirable operational features set forth above.

A key feature of this invention is the provision of a mounting bracket of extremely simple construction which attaches the resilient prong element of a protective latch to a door or drawer closure member in a secure, yet readily detachable manner. To this end a bracket which is structurally discrete from a latch prong is rigidly fixed to the closure member by any suitable means such as fasteners or adhesive. A recessed rear wall of the bracket cooperates with a facing surface of the closure to define an upwardly opening cavity into which the flanged, proximate end of the prong may be slidably inserted and thereafter retained. When it is desired to render the latch inoperate, the flanged end of the prong is drawn upwardly from the bracket cavity, inverted, and then reinserted in the cavity. In the reversed or inverted condition, the hook formed at the prong's distal end extends away from its coacting stop member; therefore, the latch cannot function in its normal fashion to limit opening of the closure. However, the latch may be reactivated simply by inverting the prong and its hook with respect to the mounting bracket. While each of Varlet, Harmony and Hillman illustrate a prong which may be disabled by detaching the same from its mounting bracket, none suggests a rationale for subsequent prong inversion or a workable structural accomodation for reattachment of the inverted prong to the bracket.

This surprisingly simple but effective mounting means provides quick and easy conversion of the latch between operative and inoperative conditions; requires no tool to accomplish such conversion; and, stores the detached prong where it will not be misplaced or lost but remains available for immediate reattachment to the bracket.

A specific object is the provision of a compact, one-piece prong mounting block which coacts with the confronting surface of the closure member to which it is fixed to define an upwardly opening cavity having substantially the same shape and dimensions as an orthogonal prong base intended to be captured in said cavity. Opening perpendicularly from the base-receiving cavity in the mounting block is an upwardly open channel or trough through which extends the elongated shaft of a prong having it flanged base captured in the aforesaid cavity. This channel is dimensioned to permit full downward flexing of the prong shaft for releasing the latch and to accept the prong shaft fully when the prong is in its inverted and stored position.

A still more specific object of this invention is the provision of a mounting block which coacts with the planar surface of an associated closure to define a prong-storage chamber into which a prong, once removed from the block, may be inserted and removably retained. In the fully inserted condition, only a flat, orthogonal prong base extends from the chamber to one side of the block while the entire length of the prong is disposed inside the chambered block. With this advantageous arrangement, a stored prong does not extend significantly from the bracket itself; therefore, the prong will not obstruct items stored in an associated cabinet or drawer compartment, will not create a hazardous projection when a closure is left open, but, will shield the prong itself from damage or displacement due to accidental impacting.

A further object is the provision of a mounting block of the character described herein which is small yet able to provide means for storing a detached prong in its inverted. position or alternately within the aforedescribed sheath-like storage chamber.

Other specific objects are realized by providing a prong mounting block for a latch exhibiting the following advantages features and characteristics:

- The mounting block can be fabricated from wood, plastic or metal by well-known mechining operations or molding technics.
- The block can be easily assembled to a closure by common threaded fasteners or by adhesive means.
- The block can be shaped and finished in such a fashion as not to detract from the appearance of the cabinet to which it is attached.
- Due to the simplicity of its structure, the block can be mass produced at low cost and sold at a correspondingly low price.
- Due to its compactness, the block can be packaged with the other latch componets without a significant increase in size or cost of such packaging.

These and other advantages and objects of this invention and the manner of attaining them will become apparent and the invention will be best appreciated and fully understood by having reference to the following detailed description of embodiments of the invention taken in conjunction with the accompanying drawings.

DETAILED DESCRIPTION OF THE EMBODIMENTS OF THE INVENTION

Figure 2:
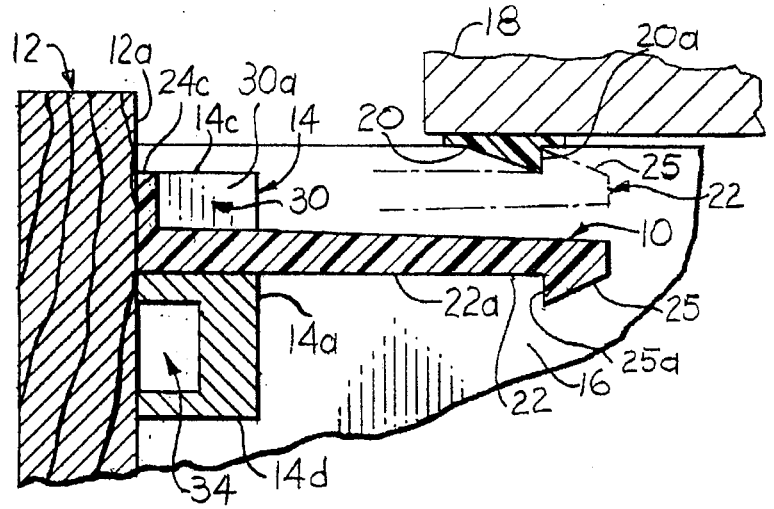

In accordance with this invention, a flexible latch prong 10 is removably secured to a drawer closure member 12 by means of a unitary mounting block or bracket fixed to the member 12 and indicated in its entirety by numeral 14. FIG. 2 shows the assembled prong 10 and bracket 14 mounted on the front closure 12 of a drawer 16 which is movable with respect to a cabinet 18 for opening and closing. A stop member 20 depends from the lower surface of a horizontally disposed component of the cabinet 18. Those familiar with security latches of the type to which this invention pertains will understand that the prong 10 could be similarly mounted on a pivoted door closure if desired.

Figure 1:
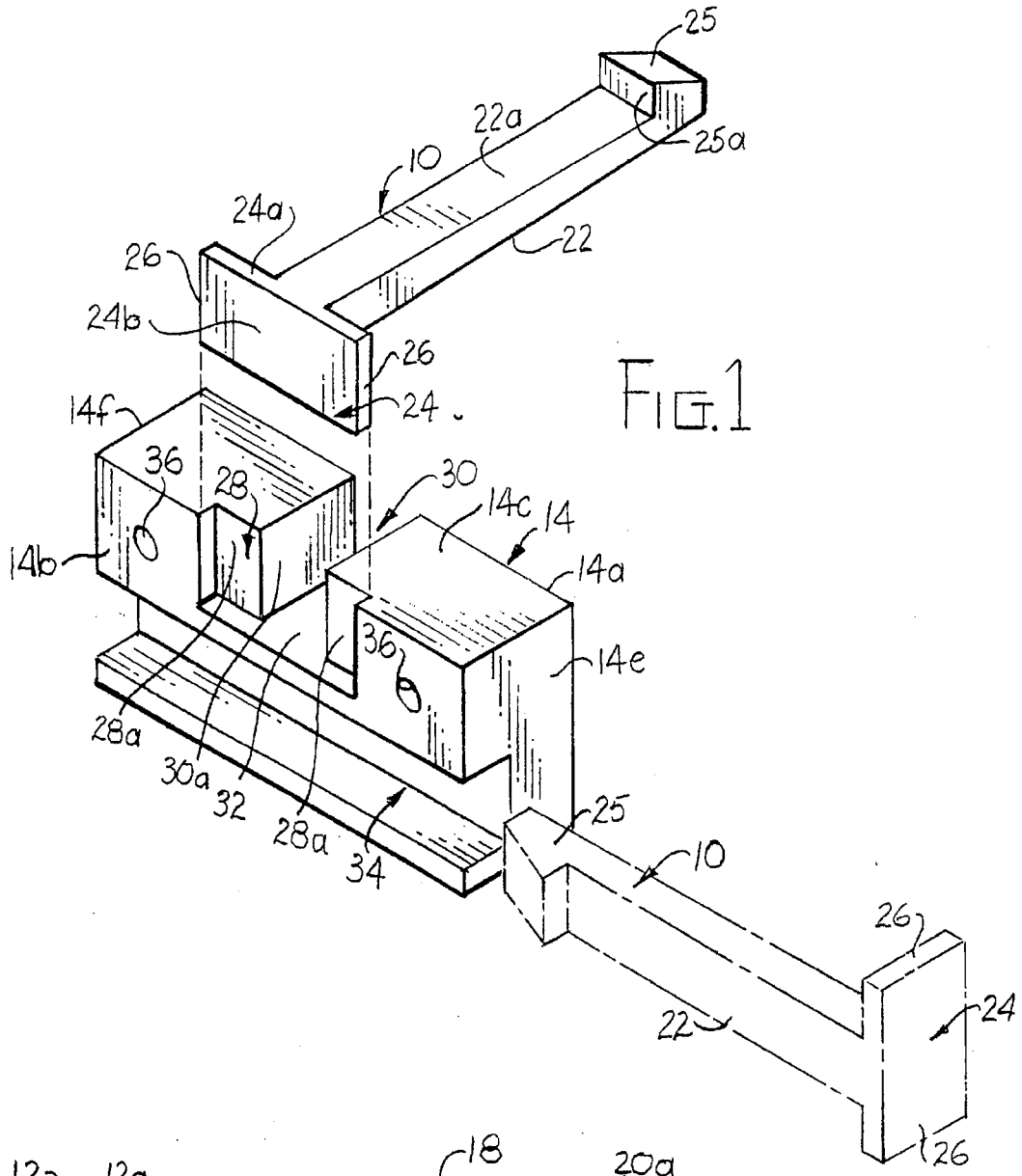
FIG. 1 is an exploded perspective view of a mounting block and prong showing the prong in two disassembled positions; and, FIG. 2 is a transverse section taken medially through the block showing fragments of a closure and cabinet with which the latch parts are associated and further showing in phantom lines a fragmentary prong engaged with a stop member.

As best illustrated in FIG. 1, the prong comprises a flexible, elongated shaft 22 having at its proximate or attached end an integrally formed base or foot 24 and having at its distal or projecting end an integrally formed hook or catch 25. Preferably the prong is molded in one piece from a suitably strong, yet flexible plastic material. In the drawing, the shaft is depicted as having a rectangular cross section and is slightly tapered from its base end to its hook end; however, the specific shape and size of the shaft is not critical to this invention. The hook 25 has a vertical face 25*a* which, as shown in phantom lines in FIG. 2, is abuttable with the confronting vertical face 20*a* of the stop member 20 when the prong operates to limit drawer opening in the manner and for the purpose set forth above. As viewed in the upper left portion of FIG. 1, the prong base 24 projects downwardly below the longitudinal centerline of the prong shaft 22; and, the upper surface 22*a* of the shaft lies in a common plane with the top marginal surface 24*a* of the base. The prong base 24 is somewhat wider than the prong shaft 22 and includes opposed flanges 26 which extend laterally beyond the sides of the shaft 22 which projects medially from the base 24 between the flanges 26. The base 24 essentially comprises a plate which is orthogonal and has a rectangular rear surface 24*b*. The shorter dimension of surface 24*b* is considerably greater than the vertical thickness of the shaft 22 to which it is integrally attached. This characterizing feature of the prong 10 is best illustrated in FIG. 2 where the prong 10 is inverted for a purpose to be described.

Turning now to the mounting block or bracket 14, the drawings show that this key element of the present invention comprises an elongated block having opposed front and rear walls 14*a* and 14*b*, opposed top and bottom surfaces 14*c* side walls 14*d* and opposed side walls 14*e* and 14*f*. These walls and surfaces are generally planar and intersect at right angles to one another; however, the surfaces and intersecting corners of the block 14 as well as the prong 10 may be shaped as required or desired to enhance the ornamental appearance of the parts or to facilitate their manufacture. The side-to-side dimension of the illustrative block 14 is substantially greater than either its top to bottom dimension or its front to back dimension.

As best shown in FIG. 1, a shallow recess or cavity 28 relieved in the rear wall 14*b* of the bracket opens to the top bracket surface 14*c*. Looking toward the rear bracket wall 14*b*, it will be seen that the cavity 28, like the prong base 24, is generally rectangular and is dimensioned to accept the prong base 24 as it is inserted downwardly with respect to bracket 14 along the broken lines shown in FIG. 1. The front-to-back dimension of the cavity 28 between the rear wall 14*b* and the upright front wall 28*a* of the cavity is made slightly less than the thickness of the base 24. This slight interference to the insertion and withdrawal of the base 24 creates a minimal, but desirable, amount of frictional rubbing as the base slides between upright wall 28*a* of the cavity 28 and the drawer closure surface 12*a* confronting the cavity 28.

A slot 30 for receiving the prong shaft 22 opens to the front and top bracket surfaces 14*a* and 14*c*, respectively, and opens medially through the upright wall 28*a* of the cavity 28. Preferably the cavity 28 and the slot 30 have like vertical dimensions which provide vertical clearance between the prong shaft 22 and bottom surface 32 of the slot thereby allowing the shaft to be digitally flexed downwardly to release hook 26 from the stop member 20. The clearance between the slot walls 30*a* and the prong shaft 22 is such that the shaft can flex freely relative to its base 24.

From the foregoing description of the latch prong 10 and its mounting bracket 14, it will be understood that the cavity 28 and slot 30 comprise a receptacle capable of fully receiving the prong's shaft 22 and base 24 after the prong is inverted from its operative attitude shown in solid lines in FIG. 1 to its inoperative attitude shown in longitudinal cross section in FIG. 2. In its inverted orientation with the bracket 14, the prong base 24 has its extending flanges 26 captured between the cavity walls 28*a* and the confronting upright surface 12*a* of the drawer front 12. A portion of the longitudinally extending prong surface 22*a* is supported on the common bottom surface 32 of the cavity 28 and the slot 30; and; an edge surface 24*c* of the prong base 24 registers with the top bracket surface 14*c* as best shown in FIG. 2.

An important feature of this invention is the provision of an elongated chamber or groove 34 which opens to the rear wall 14*b* and to the end walls 14*e* and 14*f* of bracket 14. As best illustrated in FIG. 1, the longitudinal centerline of this groove 34 extends parallel to but somewhat below the common bottom surface 32 of the cavity 28 and slot 30. FIG. 2, shows that the chamber 34 is closed by the confronting upright drawer surface 12*a* when the bracket is attached thereto. A detached latch prong 10, shown in phantom lines in FIG. 1, has been removed from the bracket 14 and positioned to address the entrance to chamber 34 which opens through the end wall 14*e*. Inasmuch as the groove 34 is intended to serve as a storage chamber or sheath for the detached prong 10, its cross sectional dimensions and end-to-end length are selected to accept and encase the entire length of the prong shaft 22. Preferably, the horizontal dimension or depth of groove 34 is selected to provide sliding frictional contact between the projecting prong hook 26 and the drawer surface 12*a*; however, the vertical dimension of goove 34 is made slightly greater than the width of the prong shaft 22. When the prong 10 is fully inserted into the groove 34, the flanges 26 of the prong base 24 will rest in abutting contact with the confronting end wall 14*e* of the bracket.

OPERATION OF THE EMBODIMENTS

The abovedescribed child-protecting latch is installed in a well-understood manner which will not be described herein except to say that the prong 10 and the stop member 20 are attached to the closure member 12 and the cabinet frame 18, respectively, in proper alignment for operative interaction. The bracket 14 which provides removable attachment of the prong 10 to the upright drawer member 12 is affixed to the same by wood screws, not shown, which extend through the spaced bores 36 in the bracket and threadably penetrate the member 12. For purposes of illustration only, the drawings show the member 12 being made of wood; however, other types of fasteners or adhesive material could be substituted for the wood screws if the member is made of metal, for example. Since it is intended that the bracket 14 remain attached to the drawer member 12 for an indeterminate period of time until the protective latch is no longer needed, unattractive screw holes are not exposed when the present latch is disabled from time to time.

In accordance with the present invention the proximate end of the latch prong 10 is removably supported within a receptacle defined by the mounting bracket 14 in either an operative mode or an inoperative mode, as desired. In the operative mode, the proximate prong base 24 is fully seated in the bracket cavity 28 and the distal prong hook 25 extends upwardly for latching engagement with the drawer stop member 20. The fragmentary prong 10, shown in FIG. 2 in phantom lines, has its flanged base 24, not shown, but identical to that depicted in FIG. 1, restrained within the cavity 28 defined between the recessed bracket wall 14*b* and the drawer front 12. The slot 30 is deep enough to accommodate downward flexing of the prong shaft 22 when the same is digitally depressed to disengage the hook 25 from the stop member 20.

As thus far described, the installation and basic operation of the subject latch is similar to that disclosed in the aforementioned U.S. Patents issued to Varlet, Harmony and Hillman. However, contrary to any suggestion found in these prior art latches, the latch disclosed herein includes special prong storing means manifested in two distinct forms.

The prong 10 is disassembled from the drawer front 12*a* by grasping the prong shaft 22 and drawing the attached prong base 24 upwardly out of the bracket cavity 28 until the base 24 clears the bracket in the manner shown in FIG. 1. However, instead of depositing the detached prong in a drawer or elsewhere thereby risking its loss or misplacement, the prong 10 may be stored directly upon the bracket 14 by inverting the prong from the operative attitude shown in FIG. 1 to the inoperative attitude shown in full lines in FIG. 2; and, thereafter, reinserting the upturned base 24 in the bracket cavity 28.

An alternative or supplemental storage means for a detached latch prong 10 is provided by the chamber 34 which extends inwardly into the bracket from either of its side wall 14*e* or 14*f*. While a bracket having only that prong storing capability just described would be appropriate in the event that the latch prong was switched between operative and inoperative conditions at closely spaced intervals, say on a daily basis, the chamber 34 provides a superior storage means for the longer term for the reasons stated hereinbefore. The FIG. 1 phantom line showing of the latch prong 10 poised for insertion into the chamber 34 indicates that the hook 25 is pointed rearwardly toward an attached drawer front 12, not shown, and that the prong base 24 extends beyond the prong shaft 22 toward the front bracket wall 14*a*. With the prong shaft inserted into the chamber from one side or the other and as far as possible, the flanges 26 of the base 24 will bear on a bracket end wall and only the relatively thin prong base 24 will remain outside the chamber 34. Withdrawal of the prong from the chamber 34 against frictional resistant created by sliding contact between the hook 25 and drawer surface 12*a* is easily accomplished without a tool by digitally grasping and pulling the protruding flanges 26.

In both of its mounted positions with respect of the bracket 14, the prong base 24 is releasably restrained in the cavity 28 by its own weight and by a certain amount of frictional resistance to sliding movement of prong base 24 relative to the upright drawer surface 12*a* and the cavity walls 28*a*. While the prong 10 is readily detachable from the bracket 14 without the use of a tool, such frictional resistance to unintended separation of the prong keeps it is place even though a drawer or door closure may be opened or closed with inordinate force.

From the foregoing description it will be appreciated that the several objectives and advantages of this invention may be realized by employing a bracket and a readily detachable prong suitable for reattachment to the bracket in an inverted, stored position; or, alternately, by employing a bracket having an internal chamber for storing a prong which is readily detachable from the bracket.

The foregoing description of the embodiments shown in the drawings are illustrative and explanatory only; and, various changes in size, shape and material as well as the specific details of the described structure and operation may be made. Therefore, we do not intend to be limited to the details shown and described herein, but intend to cover all changes and modifications which are encompassed in the scope and spirit of the appended claims.

What we claim as our invention is:

1. A bracket for mounting a latch prong having an elongated shaft with a mounting base at one end thereof, said bracket comprising a block which provides:

a) a cavity into which said base is insertable;

b) an elongated chamber into which said shaft is insertable longitudinally; and, c) a partition between said cavity and said chamber.

2. The bracket set forth in claim 1 wherein:

the longitudinal dimensions of said elongated chamber and of said elongated shaft are substantially the same.

3. The bracket set forth in claim. 1, wherein:

said elongated chamber opens to opposed surfaces of said block.

4. A safety latch assembly for limiting opening movement of a cabinet closure member with respect to stop means on said cabinet, said assembly comprising, in combination:

a) an invertible prong having a mounting base at one end thereof and an elongated shaft projecting from said base;

b) a bracket attached to an upright surface of said closure member;

c) said base being mounted on said bracket with said shaft projecting outwardly beyond an upright surface of said bracket;

d) said bracket having walls defining an open receptacle which receives said base and said shaft in either an upright position or an inverted position of said prong;

e) said shaft extends outwardly from said receptacle and projects beyond said upright surface of said bracket in both the upright position and the inverted position of said prong; and, f) substantially the entirety of said base is disposed within said receptacle in both the upright position and the inverted position of said prong.

5. The latch assembly set forth in claim 4, wherein:

a) said bracket has a planar surface;

b) said receptacle is relieved in said planar surface and comprises an interconnecting cavity and slot; and, c) said cavity and said slot are relieved in said planar surface to substantially the same depth.

6. The latch assembly set forth in claim 5 wherein:

said cavity and said slot have bottom walls; and, said bottom wall of said cavity underlies and supports said prong mounting base.

7. The latch assembly set forth in claim 6, wherein:

said bottom wall of said slot underlies said shaft and is spaced therefrom when said prong mounting base is disposed within said receptacle in said upright position of said prong.

* * * * *